US006155559A

United States Patent [19]

Klenk

[11] Patent Number: 6,155,559

[45] Date of Patent: Dec. 5, 2000

[54] DELIVERY SYSTEM FOR FLAT PRODUCTS

[75] Inventor: Rainer Klenk, St. Leon-Rot, Germany

[73] Assignee: Heidelberger Druckmaschinen Aktiengesellschaft, Heidelberg, Germany

[21] Appl. No.: 08/825,498

[22] Filed: Mar. 28, 1997

[30] Foreign Application Priority Data

Mar. 28, 1996 [DE] Germany ..... 196 12 294

[51] Int. Cl.[7] ..... B65H 31/12

[52] U.S. Cl. ..... 271/218; 271/213; 271/207; 271/214

[58] Field of Search ..... 271/218, 213, 271/214, 207

[56] References Cited

U.S. PATENT DOCUMENTS

| | | | |
|---|---|---|---|
| 5,102,117 | 4/1992 | Henn et al. . | |
| 5,244,342 | 9/1993 | De Dompierre | 271/218 X |

FOREIGN PATENT DOCUMENTS

| | | |
|---|---|---|
| 0 453 983 A1 | 10/1991 | European Pat. Off. . |
| 3941993C1 | 1/1991 | Germany . |
| 3937944C1 | 4/1991 | Germany . |
| 4131015A1 | 4/1993 | Germany . |
| 4217816A1 | 12/1993 | Germany . |
| 4221928A1 | 1/1994 | Germany . |
| 69102186T2 | 6/1994 | Germany . |
| 4217816C2 | 1/1995 | Germany . |
| 4405586C1 | 6/1995 | Germany . |
| 3535113C2 | 7/1998 | Germany . |

OTHER PUBLICATIONS

"The Continuous Delivery System (CDS)", Michael Manufacturing, Inc.

*Primary Examiner*—William E. Terrell
*Assistant Examiner*—Patrick Mackey
*Attorney, Agent, or Firm*—Herbert L. Lerner; Laurence A. Greenberg

[57] ABSTRACT

A device in a sheet delivery for accommodating flat printed products, the device having a lowerable auxiliary sheet stack frame arranged between two side walls of the sheet delivery, includes respective lifting devices to which the auxiliary stack frame, at respective corner locations thereof, is articulatedly connected, a movable auxiliary stack receiving element mounted on and completely surrounded by the auxiliary stack frame, the auxiliary stack frame being of a length in a sheet travel direction substantially equal to twice the length of the auxiliary stack receiving element.

16 Claims, 6 Drawing Sheets

DELIVERY SYSTEM FOR FLAT PRODUCTS

BACKGROUND OF THE INVENTION

Field of the Invention

The invention relates to a delivery system for flat printed products, particularly in a sheet delivery of rotary printing presses.

The published German Patent Document DE 42 21 928 A1 discloses a device for non-stop stack or pile change in a delivery. An auxiliary stack or pile carrier can be pushed in between two sheets in the conveying direction of the sheets, the incoming sheets being temporarily received on an auxiliary stack. In order to deposit the auxiliary stack on a new main stack carrier following the main stack change, suitable equipment is provided. The auxiliary stack carrier has a thin layer and remains under the auxiliary stack, so that it is effective as a base when it is deposited on the selected main stack carrier. Such an auxiliary stack carrier can either be cut from a reeled-up web or removed individually from an exchangeable cassette.

The published German Patent Document DE 44 05 586 C1 discloses a device for the precise separation of an auxiliary stack or of a main stack in a non-stop delivery in a sheet-processing printing press. In this case, the carrier and a transverse stack are vertically movably articulated by coupling elements on a crossmember which is fastened to the sheet brake. Arranged on the carrier are lower stops and wedges in the direction of the stack, and arranged parallel thereto on that side of the carrier remote from the stack is a coupling rod which is actuatable by an operating cylinder, and which actuates the rear sheet hold-up via tertiary elements.

The technical publication "The Continuous Delivery System (CDS)" of Michael Manufacturing Inc., Little Ferry, N.J. 07643, dated 1995, has disclosed an auxiliary stack base which runs in lateral guides and can be extended and retracted as required in accordance with the roller shutter principle, in order to form an auxiliary stack base. The roller shutter, which is formed of rollers joined to one another, can be placed as required above the upper side of the main stack and thus forms an auxiliary stack base onto which the sheets being produced can further be delivered. In this arrangement, the roller shutter, which is received in a lowerable loader, is lowered in accordance with the growth of the stack, until the main stack has been removed and a new stack base has been prepared.

The published German Patent Document DE 42 17 816 C2 discloses a device for the continuous delivery of flat printed products, wherein there is provided a stack separating band serving to separate the main and auxiliary stacks. This separating band has a separating edge of broadened design, which can be driven into the stack area transversely to the paper sheet travel direction.

The published German Patent Document DE 41 31 015 A1 discloses a sheet delivery having a non-stop device which includes two separating elements which are provided in the area of the stack side edges, and are movable in opposite directions from a lateral standby position into a covering position engaging over the main stack, the two separating elements, in the separating position, holding open an insertion gap for the respectively associated auxiliary stack carrier and being withdrawable when the auxiliary stack carrier has been inserted.

SUMMARY OF THE INVENTION

Proceeding from the prior art outlined hereinbefore, it is an object of the invention to provide a delivery system for flat products which offers an improvement in heretofore known sheet deliveries of rotary printing presses such that clean-edge stack formation is not impaired for all the grades of paper which can be processed in a rotary printing press during non-stop operation and a hurdling operation or operation with stillages.

With the foregoing and other objects in view, there is provided, in accordance with the invention, in a sheet delivery, a device for accommodating flat printed products, the device having a lowerable auxiliary sheet stack frame arranged between two side walls of the sheet delivery, comprising respective lifting devices to which the auxiliary stack frame, at respective corner locations thereof, is articulatedly connected, a movable auxiliary stack receiving element mounted on and completely surrounded by the auxiliary stack frame, the auxiliary stack frame being of a length in a sheet travel direction substantially equal to twice the length of the auxiliary stack receiving element.

In accordance with another feature of the invention, the accommodating device includes an auxiliary base receivable in the auxiliary stack receiving element for moving therewith in the sheet travel direction.

In accordance with a further feature of the invention, the auxiliary stack receiving element is equipped with a crossmember.

In accordance with an added feature of the invention, the accommodating device includes a rake fastenable to the crossmember.

In accordance with an additional feature of the invention, the accommodating device includes a floating table fastenable to the crossmember.

In accordance with yet another feature of the invention, the crossmember is provided with a low-pressure air supply.

In accordance with yet a further feature of the invention, a front crossmember of the auxiliary stack frame is provided with holding fingers.

In accordance with yet an added feature of the invention, the holding fingers are constructed so as to pivot downwardly.

In accordance with yet an additional feature of the invention, the auxiliary stack receiving element is movable into a main stack region, and the holding fingers support front ends of rake tines in a condition wherein the auxiliary stack receiving element has been moved into the main stack region.

In accordance with still another feature of the invention, the auxiliary stack frame is provided with shock absorbers for damping an end position of the movable auxiliary stack receiving element.

In accordance with still a further feature of the invention, the auxiliary stack frame, in the longitudinal direction thereof, is formed of hollow profiles.

In accordance with still an added feature of the invention, the accommodating device includes adjusting elements for moving the auxiliary stack receiving element, the adjusting elements being accommodated in the hollow profiles.

In accordance with still an additional feature of the invention, the adjusting elements are constructed as pneumatic cylinders without piston rods.

In accordance with another feature of the invention, the hollow profiles are formed with longitudinal slots over a range of travel of the adjusting elements, a respective entraining member extending through each of the longitudinal slots.

In accordance with a further feature of the invention, the accommodating device includes respective sensors mounted on the adjusting elements for interrogating travel paths of the adjusting elements over the range of travel.

In accordance with a concomitant feature of the invention, the accommodating device is in combination with a printing press.

The advantages which can be achieved by the device according to the invention are many and varied. The auxiliary stack frame surrounds the movable auxiliary stack receiving element and forms a rigid receiving system wherein an auxiliary stack is reliably movable. The integration of the movable auxiliary stack receiving element into the auxiliary stack frame allows simple exchanging of the auxiliary stack carrier with few actions. Because, in addition, the movement of the auxiliary stack receiving element and the auxiliary stack carrier is performed in the paper sheet running or travel direction during the stack separating procedure, clean-edge stack formation is not impaired.

It is possible to fasten either a rake table or a floating table, in a crossmember, to the movable auxiliary stack receiving element, which can be moved in the paper running or travel direction. The air connection to the floating table is effected via an air supply provided in the crossmember of the movable auxiliary stack receiving element. A crossmember which located at the front part of the auxiliary stack frame is provided with holding fingers; these holding fingers are spring-preloaded and, in order to avoid injury to the pressman, can also be pivoted downwardly. When using a rake, which is mounted with its rear area on the crossmember of the movable auxiliary stack receiving element, the front ends of the rake tines are supportable by the holding fingers in the position wherein the auxiliary stack receiving element has been moved into the main stack region.

In further refinement of the idea upon which the invention is based, it is possible to introduce into the auxiliary receiving stack element an auxiliary stack base, either a floating table or a rake having a plurality of rake tines arranged alongside one another over the stack width. In order to connect the floating table to the air supply, the crossmember of the auxiliary stack receiving element is provided with a low-pressure air supply.

The auxiliary stack frame is provided at a front crossmember thereof with holding fingers which are constructed so that they are pivotable. The holding fingers support the front end of rake tines, if a rake is mounted in the auxiliary stack receiving element. In this way, uniform support is achieved for the auxiliary stack base which has moved into the main stack region and is, respectively, provided in the auxiliary stack receiving element. Furthermore, provision can be made in the auxiliary stack receiving element for a transmitting element of a light barrier, and the receiver therefor can also be provided either on the auxiliary stack receiving element or on the auxiliary stack frame. For the purpose of damping the end position, shock absorbers, which effect a cushioning of the travel movement of the auxiliary stack receiving element, are provided on the auxiliary stack frame.

The auxiliary stack frame includes hollow profiles which accept adjusting units or elements such as, for example, pneumatic cylinders without piston rods. Dogs, which initiate the movement of the auxiliary stack receiving element, project into the hollow profiles of the auxiliary stack frame through a longitudinal opening extending over the range of travel of the adjusting units. The travel of the adjusting units in the hollow profiles can be interrogated or sensed by sensors. In this case, inductively operating sensors or the like can be employed.

Other features which are considered as characteristic for the invention are set forth in the appended claims.

Although the invention is illustrated and described herein as embodied in a delivery system for flat products, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
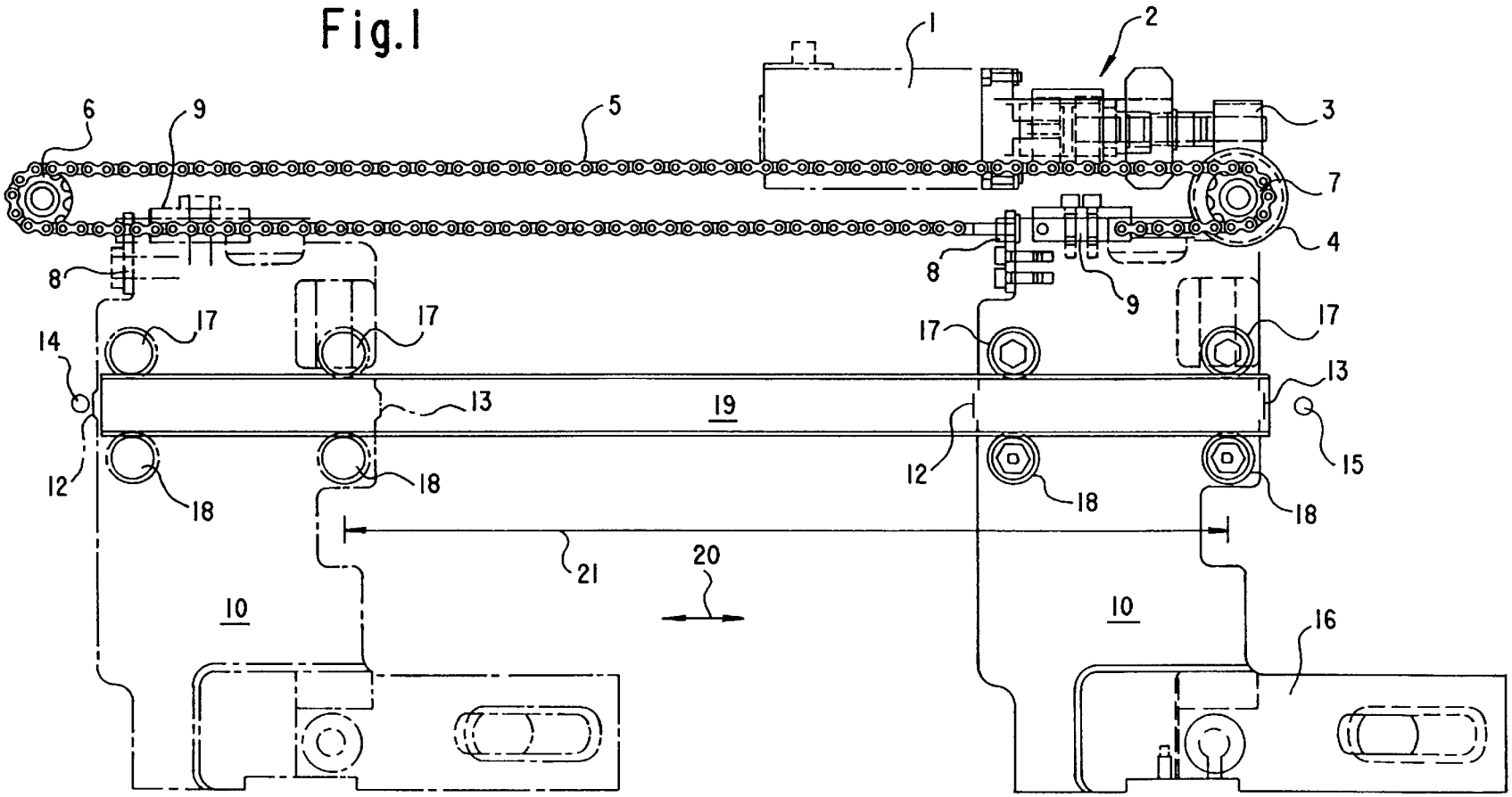
FIG. 1 is a top, front and right-hand side perspective view of a sheet delivery in a printing press, a side wall opposite to the side wall at the left-hand side having been omitted in the interest of clarity.

Referring now to the drawings and, first, particularly to FIG. 1, there is shown therein, in a perspective view, a sheet delivery, of which one of the side walls 1 has been omitted in the interest of clarity.

The side wall 1 of the sheet delivery is supported, on the one hand, on two columns 4 and, on the other hand, adjoins at the right-hand side thereof a sheet delivery section of an otherwise non-illustrated rotary printing press. The side wall 1 is provided with openings 2 and 3, which serve for the lateral insertion of carrier elements, which are thus easily exchangeable. Shown at the bottom of the side wall 1 is a pallet 6 resting on a stack carrier 5, which can be conveyed up and down, fastened to a lifting device. Arranged above an auxiliary stack frame 13 is a frame structure 7 which is provided on both sides with deflection rollers 9 and 10. A separating band 8, which is moved by a drive mounted in the crossmember 11, revolves around the deflection rollers 9 and 10. Furthermore, a sheet brake 12 is mounted on the frame structure 7.

The auxiliary stack frame 13 is formed by two parallel hollow profiles 14 and 15 which are connected to one another by a front crossmember 16 and a rear crossmember 17. An auxiliary stack receiving element 19 is movable horizontally in the auxiliary stack frame 13. Provided on the auxiliary stack receiving element 19 are driver strips 20 and 21 which are movable by dogs 30 (note FIG. 2) passing through the hollow profiles 14 and 15 at the inner side thereof. In the exemplary embodiment of FIG. 1, a rake 23 having rake tines extending alongside one another in the paper running or travel direction is received in the auxiliary stack receiving element 19 on the crossmember 22. The auxiliary stack receiving element 19, which is movable with low friction in the horizontal direction in linear guides 32 provided on the hollow profiles 14 and 15, has runners 26 and 27, respectively, at the sides thereof. The auxiliary stack frame 13 is articulatedly connected at corner locations thereof to a lifting device 36, which affords a vertical movement of the entire auxiliary stack frame 13 upwardly or downwardly. Both the drive 39 for the lifting device 36 and a chain storage are indicated by dash-dot or phantom lines. The upper ends of the chains carrying the auxiliary stack frame 13 are wound up by the chain storage.

Figure 2:
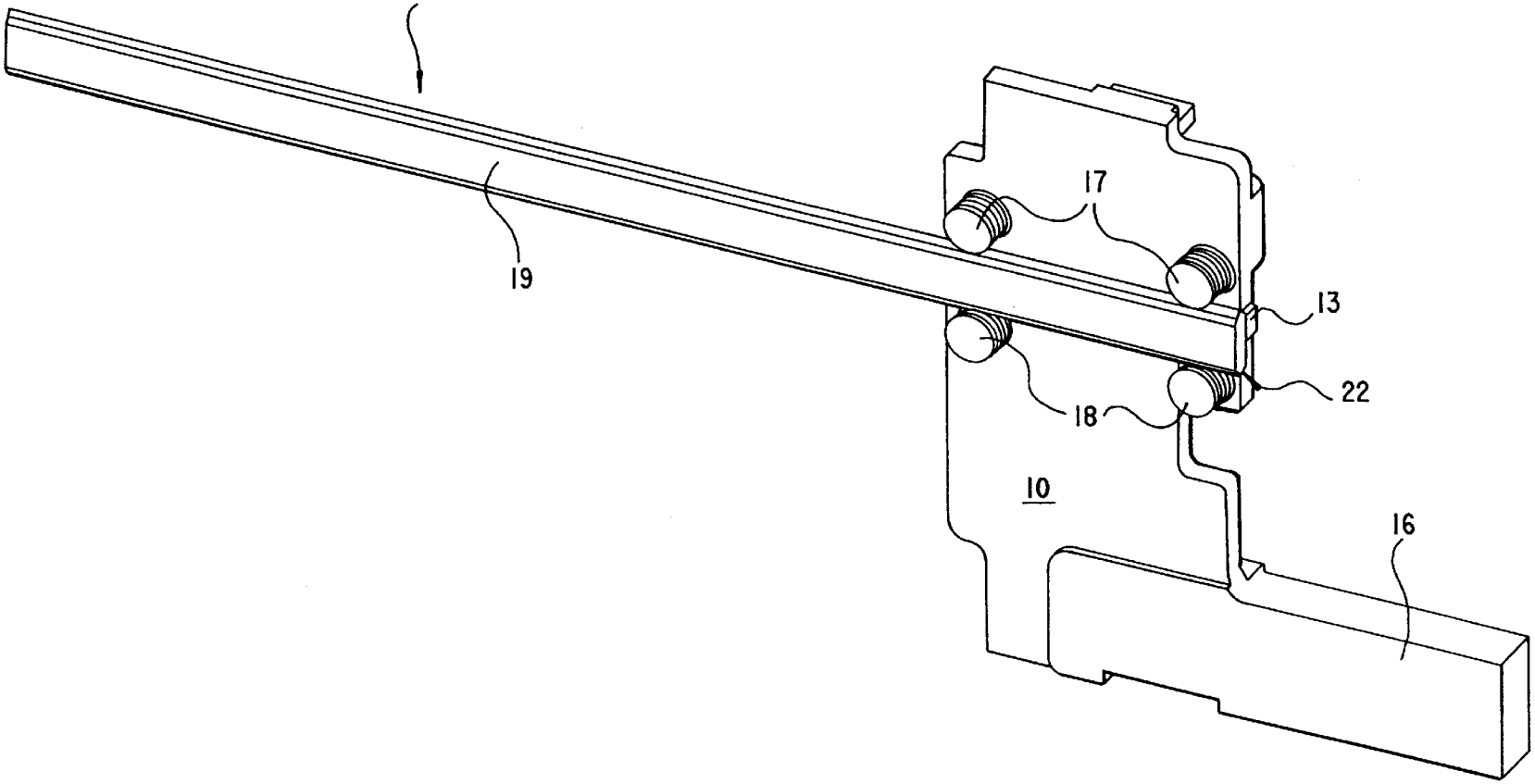
FIG. 2 is a top plan view of an auxiliary stack or pile frame having an auxiliary stack receiving element whereon a rake is mounted.

FIG. 2 is a plan view of the auxiliary stack frame having an auxiliary stack receiving element whereon a rake 23 is mounted in this embodiment of the invention.

The rake 23 has rake strips 24 by which it is fastened to the crossmember 22 of the auxiliary stack receiving element 19. Provided on both sides of the auxiliary stack receiving element 19 are driver or entrainer strips 20 and 21, which are connected to the crossmember 22. On the upper driver strip 21, the positions at which the runners are fastened to the driver strip 21 are designated by reference numerals 26 and 27. For reasons of symmetry, this also applies to the opposite driver strip 20. Shown underneath the driver strips 20 and 21 and partly concealed thereby are the linear guides 32 wherein runner rollers of the runners 26 and 27 move and in this way ensure exact guidance of the auxiliary stack receiving element 19 in the horizontal direction. Shown with a dash-dot or phantom line directly opposite the front crossmember 16 of the auxiliary stack frame 13 is the rake 23 in the position thereof wherein it has been moved forward into the main stack area. Provided on the front crossmember 16 are holding fingers 18, by which the front regions of the individual rake tines 25 are supported. In the interest of safety, these holding fingers 18 are pretensioned by spring elements, in order to keep the risk of injury low. By supporting the front regions of the rake tines 25, the curvature of the auxiliary stack surface is kept within limits and a higher delivery accuracy is achievable.

In the plan view of the auxiliary stack frame 13, it is possible, moreover, to see the articulation point 28 for the pulling device 36. In order to prevent the auxiliary stack frame 13 from sliding, guide elements are mounted on the outer sides of the auxiliary stack profiles 14 and 15. Accommodated in the hollow profile 14 is an adjusting element 29, preferably formed as a pneumatic cylinder without a piston rod, whereon a laterally projecting dog 30 is mounted. The dog 30 is positively or formlockingly connected to the respective dog strip 20 or 21 assigned thereto and, in this manner, transmits the movement of the adjusting elements 29 in the hollow profiles 14 and 15 to the auxiliary stack receiving element 19. In the foregoing regard, it is noted that a formlocking connection is one which connects two elements together due to the shape of the elements themselves, as opposed to a forcelocking connection, which locks the elements together by force external to the elements. The dogs 30 of the adjusting elements 29 move along the travel path in the hollow profiles 14 and 15 in slot-like openings 43, which extend along the hollow profiles 14 and 15. At front ends of the driver strips 20 and 21, there are stops 44 for stillage or hurdle boards 34 to be inserted. The stillage boards 34 are fitted from the side through slot-like openings 2 onto the respectively provided auxiliary stack receiving element 19. The aforementioned hollow profiles 14 and 15 are equipped with sensors which sense the position of the runner to which the dog 30 of the adjusting elements 29 is fastened. With these sensors integrated into the adjusting elements 29, it is possible to sense whether the auxiliary stack receiving element 19 has or has not reached the front or rear position thereof in the auxiliary stack frame 13. The front and the rear crossmembers 16 and 17, respectively, of the auxiliary stack frame 13 are provided with shock absorber units 45 which damp the accelerated mass during braking and stopping of the auxiliary stack receiving element 19 in its end positions. Furthermore, a further transmitting element 46.2 of a light barrier is accommodated in the crossmember 22. The front crossmember 16 of the auxiliary stack frame 13 has a receiver part 46.1 of a light barrier which senses elements coming from below, such as, for example, the stack carrier 5 and the pallet 6.

Figure 3:
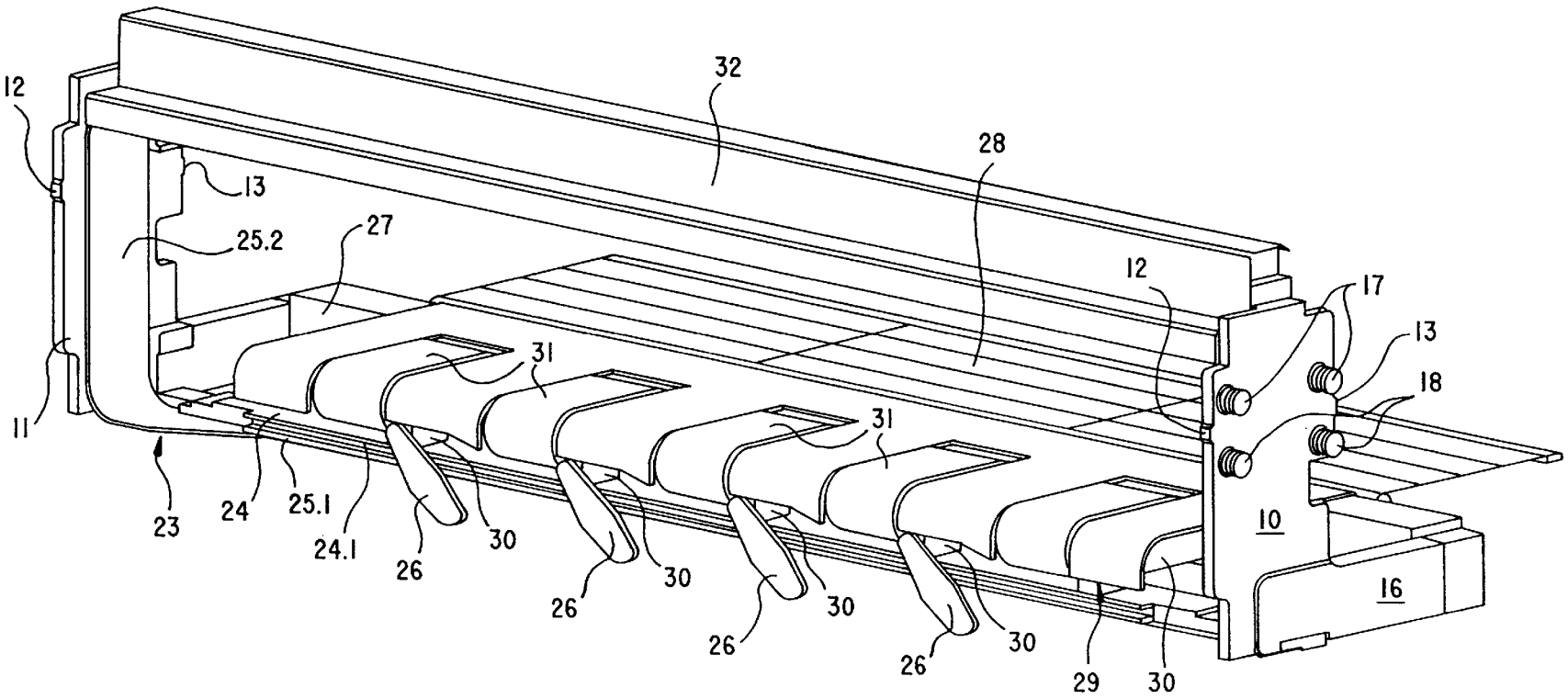
FIG. 3 is a cross-sectional view of FIG. 2 taken along the line III—III in the direction of the arrows.

FIG. 3 is a longitudinal sectional view of the auxiliary stack frame 13.

Both the holding fingers 18 and the shock absorbers 45 are mounted on the front crossmember 16. The lower part of the hollow profile 14 of the auxiliary stack frame 13 carries the linear guide 32, whereon the runner rollers 31 of the two runners 26 and 27 move in the horizontal direction. The two runners 26 and 27 are fastened to the auxiliary stack receiving element 19 and ensure the low-friction horizontal movement thereof. Mounted on the rear crossmember 17 of the auxiliary stack frame 13 is a pneumatic manifold 35. The loading of the adjusting elements 29, which are accommodated in the hollow profiles 14 and 15, and are preferably constructed as pneumatic cylinders without piston rods, is additionally performed by the pneumatic manifold 35.

If a floating table 33 is used as the base in the auxiliary stack receiving element 19, the rear crossmember 17 can be connected to a blower, by which an air cushion is built up on the floating table 33 by low-pressure air.

The auxiliary stack receiving element 19 is in the position thereof wherein it is withdrawn from the main stack area, as shown in FIG. 3. The articulation point for a pulling device 36 is identified by reference numeral 28. Further articulation points 28 for the respective pulling device 36 are located at the corners of the auxiliary stack frame 13.

Figure 4:
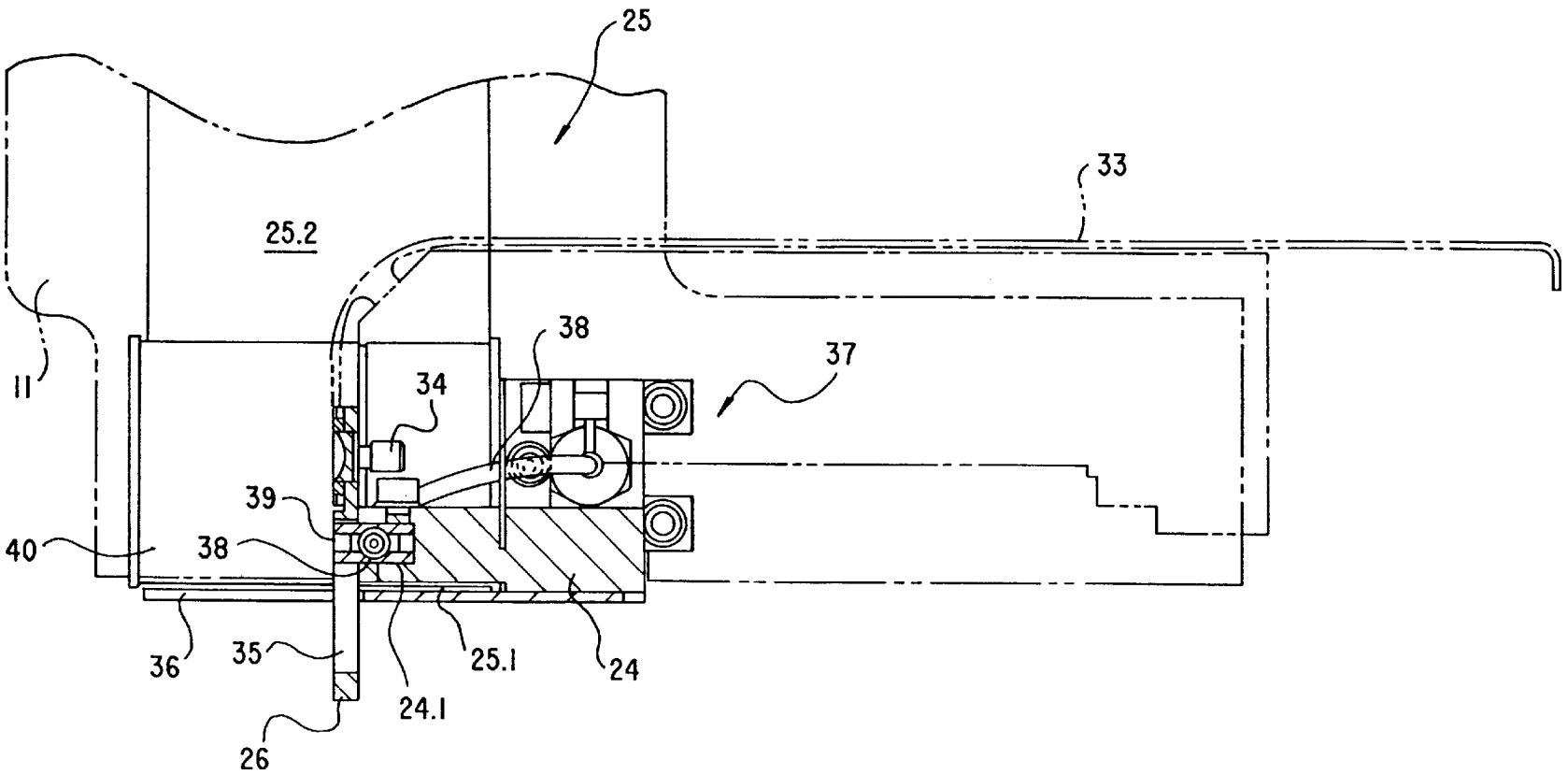
FIG. 4 is an enlarged fragmentary sectional view of FIG. 2 taken along the line IV—IV in the direction of the arrows and showing a hollow profile in greater detail.

FIG. 4 is an enlarged cross-sectional view of one of the hollow profiles shown in FIG. 2.

One of the pulling devices 36 with which the auxiliary stack frame 13 is moved up and down is fastened to the articulation point 28 of the auxiliary stack frame 13. Accommodated within the hollow profile 14 is the adjusting element 29, which is connected via the dog 30 (note FIG. 2) to the driver strip 21 and ensures the movement of the auxiliary stack receiving element 19. Fastened underneath the driver strip 21 are the runners 26 and 27, the runner rollers 31 of which are guided on a linear guide 32 which is provided on the hollow profile 14. In the exemplary embodiment of FIG. 4, a rake 23 is fastened to the crossmember 22 of the auxiliary stack receiving element 19. The rake strip 24, whereon the individual rake tines 25 are provided, is connected to the crossmember 22 of the auxiliary stack receiving element 19.

Figure 5:
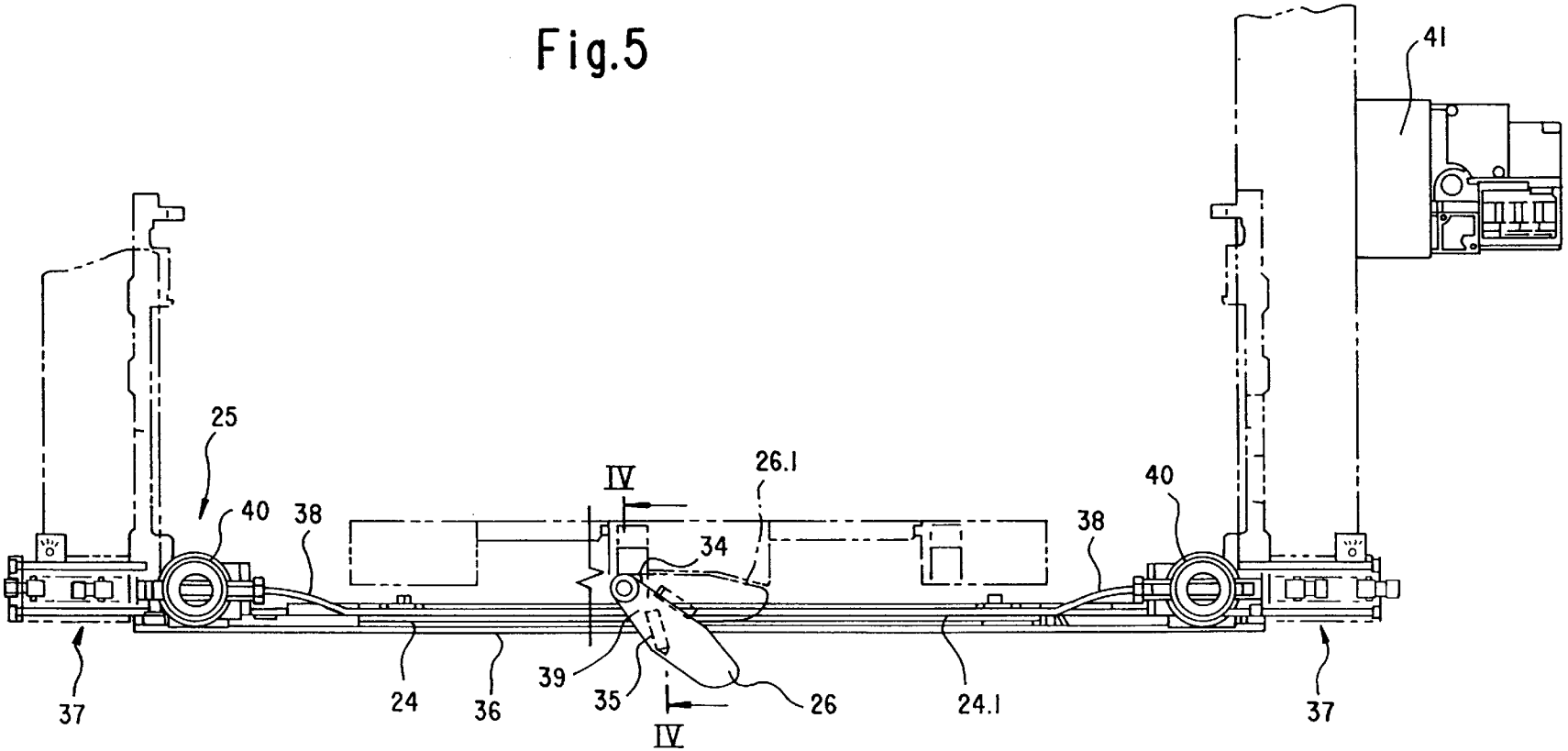
FIG. 5 is an enlarged sectional view, partly broken away, of FIG. 2 taken along the line V—V in the direction of the arrows and showing details of the auxiliary stack frame with the mounted rake.

FIG. 5 is a cross-sectional view of the auxiliary stack frame 13 over the entire width thereof.

The hollow profiles 14 and 15, wherein the adjusting units 29 are accommodated, are fastened to the auxiliary stack frame 13 which is suspended on both sides in respective pulling devices 36. The driver strips 20 and 21, to which the auxiliary stack receiving element 19 is fastened, are moved by the adjusting units 29. Mounted on the crossmember 22 of this auxiliary stack receiving element 19 is a rake 23 having tines 25 whereon a build-up of a new auxiliary stack can take place.

Figure 6:
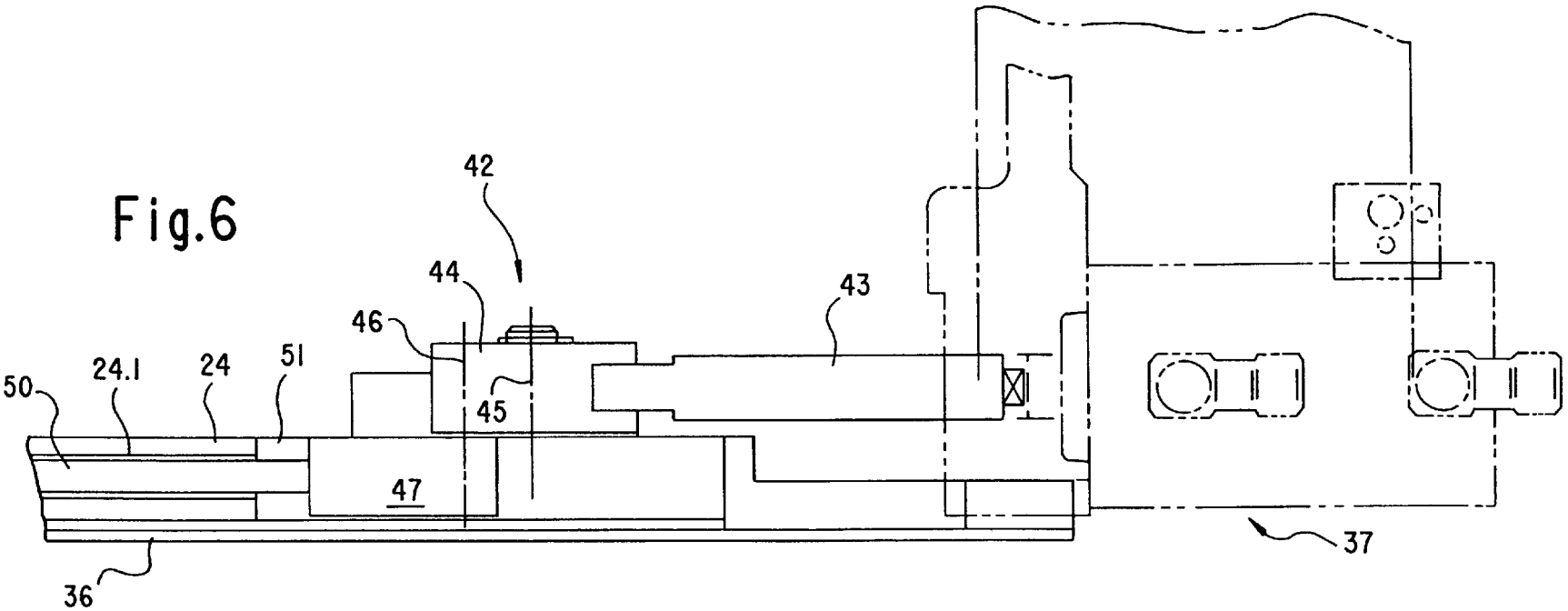
FIG. 6 is a fragmentary side elevational view of the sheet delivery with a multiplicity of different embodiments of the auxiliary stack bases.

FIG. 6 is a side elevational view of the sheet delivery.

The respective pulling devices 36 moving the auxiliary stack frame 13 up and down are moved by the drive 39 and are guided deflection wheels 40 and 41. The drive 39 for the pulling devices 36 is mounted in side walls 1 supported in the main stack area by columns 4 which ensure the accessibility of the main stack. The sheets, which are transported in the paper running or travel direction 42, are held in gripper bars 38, which circulate or revolve on transport chains 37. The build-up of the auxiliary stack is performed following the movement of the auxiliary stack receiving element 19 in the paper running direction 42 into the main stack area. The main stack is discharged and processed further, while the copies from the continuous production printing on the press are delivered on the auxiliary stack receiving element 19. The rake 23 can be let into or embedded in the latter, as mentioned hereinbefore, or else the floating table 33, which is provided with low-pressure air to build up an air cushion, or a stillage or hurdle board 34 may be so embedded.

The auxiliary stack receiving element 19 has, on the driver strips 20 and 21 thereof, runners 26 and 27 having runner rollers 31 which are guided on the hollow profiles 14 and 15. The slot-shaped openings 43 (note FIG. 3), respectively, are traversed by the dogs 30, which are connected to the driver strips 20 and 21.

I claim:

1. In a sheet delivery, a device for accommodating flat printed products, comprising:

a lowerable auxiliary stack frame provided between two side walls of the sheet delivery;

respective lifting devices to which said auxiliary stack frame is connected;

a movable auxiliary stack receiving element mounted on and completely surrounded by said auxiliary stack frame, said movable auxiliary stack receiving element being equipped with an auxiliary base selected from the group consisting of a rake, a floating table, and a stillage board, and further with a cross member for exchanging said auxiliary base with a further auxiliary base selected from the group consisting of a rake, a floating table, and a stillage board, said auxiliary stack frame being of a length in a sheet travel direction substantially equal to twice the length of said auxiliary stack receiving element.

2. The device according to claim 1, wherein said at least one auxiliary base is receivable in said auxiliary stack receiving element for moving therewith in said sheet travel direction.

3. The device according to claim 1, wherein said rake is fastenable to said crossmember.

4. The device according to claim 1, wherein said floating table is fastenable to said crossmember.

5. The device according to claim 1, wherein said crossmember is provided with a low-pressure air supply.

6. The device according to claim 1, wherein a front crossmember of the auxiliary stack frame is provided with holding fingers.

7. The device according to claim 6, wherein said holding fingers are constructed so as to pivot downwardly.

8. The device according to claim 6, wherein said auxiliary stack receiving element is movable into a main stack region, and said holding fingers support front ends of rake tines in a condition wherein said auxiliary stack receiving element has been moved into the main stack region.

9. The device according to claim 1, wherein the auxiliary stack frame is provided with shock absorbers for damping an end position of said movable auxiliary stack receiving element.

10. The device according to claim 1, wherein the auxiliary stack frame, in the longitudinal direction thereof, is formed of hollow profiles.

11. The device according to claim 10, including adjusting elements for moving said auxiliary stack receiving element accommodated in said hollow profiles.

12. The device according to claim 11, wherein said adjusting elements are constructed as pneumatic cylinders without piston rods.

13. The device according to claim 11, wherein said hollow profiles are formed with longitudinal slots over a range of travel of said adjusting elements, a respective entraining member extending through each of said longitudinal slots.

14. The device according to claim 11, including respective sensors mounted on said adjusting elements for interrogating travel paths of said adjusting elements over said range of travel.

15. The device accommodating flat printed products in a sheet delivery according to claim 1, wherein the device is in combination with a printing press.

16. The device according to claim 1, wherein said auxiliary stack frame, at respective corner locations thereof, is articulatedly connected to respective lifting devices.

* * * * *